US011793275B2

(12) United States Patent
Bock et al.

(10) Patent No.: US 11,793,275 B2
(45) Date of Patent: Oct. 24, 2023

(54) SHOE, ESPECIALLY A SPORTS SHOE

(71) Applicant: PUMA SE, Herzogenaurach (DE)

(72) Inventors: Markus Bock, Herzogenaurach (DE); Randolph Maussner, Spalt (DE)

(73) Assignee: PUMA SE, Herzogenaurach (DE)

( * ) Notice: Subject to any disclaimer, the term of this patent is extended or adjusted under 35 U.S.C. 154(b) by 11 days.

(21) Appl. No.: 17/251,099

(22) PCT Filed: Jun. 14, 2018

(86) PCT No.: PCT/EP2018/065754
§ 371 (c)(1),
(2) Date: Dec. 10, 2020

(87) PCT Pub. No.: WO2019/238231
PCT Pub. Date: Dec. 19, 2019

(65) Prior Publication Data

US 2021/0177099 A1 Jun. 17, 2021

(51) Int. Cl.

| | |
|---|---|
| ***A43B 3/34*** | (2022.01) |
| ***A43C 11/00*** | (2006.01) |
| ***A43C 11/16*** | (2006.01) |

(52) U.S. Cl.
CPC ..... *A43C 11/00* (2013.01); *A43B 3/34* (2022.01); *A43C 11/165* (2013.01)

(58) Field of Classification Search
CPC ..... A43C 11/165; A43C 11/00; A43C 11/16; A43C 3/34
See application file for complete search history.

(56) References Cited

U.S. PATENT DOCUMENTS 4,300,256 A * 11/1981 Laganas ..... A43B 3/103 12/142 F
5,205,055 A * 4/1993 Harrell ..... A63C 17/20 36/50.1

(Continued)

FOREIGN PATENT DOCUMENTS

CA 2911999 A1 5/2017
CN 106231941 A 12/2016

(Continued)

OTHER PUBLICATIONS

First Office Action from corresponding Japanese Patent Application No. 2020-569732 dated Jan. 25, 2022 (11 pages) (English translation included).

(Continued)

*Primary Examiner* — Katharine G Kane
(74) *Attorney, Agent, or Firm* — Quarles & Brady LLP

(57) ABSTRACT

The invention relates to a shoe (1), especially to a sports shoe, with a shoe upper (2) and a sole (3) connected with the shoe upper (2), wherein the shoe (1) comprises a central fastener (4) for lacing the shoe (1) at the foot of a wearer, wherein the central fastener (4) comprises at least one tensioning element (5) which is arranged on or in a region of the shoe upper (2) by which a lacing force can be exerted onto the region of the shoe upper (2) and at least one gear element (6) driven by an electric motor (7), wherein a section (8) of the tensioning element (5) can be pulled against a fixed location (9) of the shoe (1) by means of the gear element (6) to create a tensioning force for lacing the shoe (1) at the foot of the wearer. To provide a compact central closure system the invention proposes that the section (8) of the tensioning element (5) is a strap which comprises a gearing (10) or a profile, wherein the gear element (6) comprises a worm (11) which engages into the (Continued)

Figure 1:
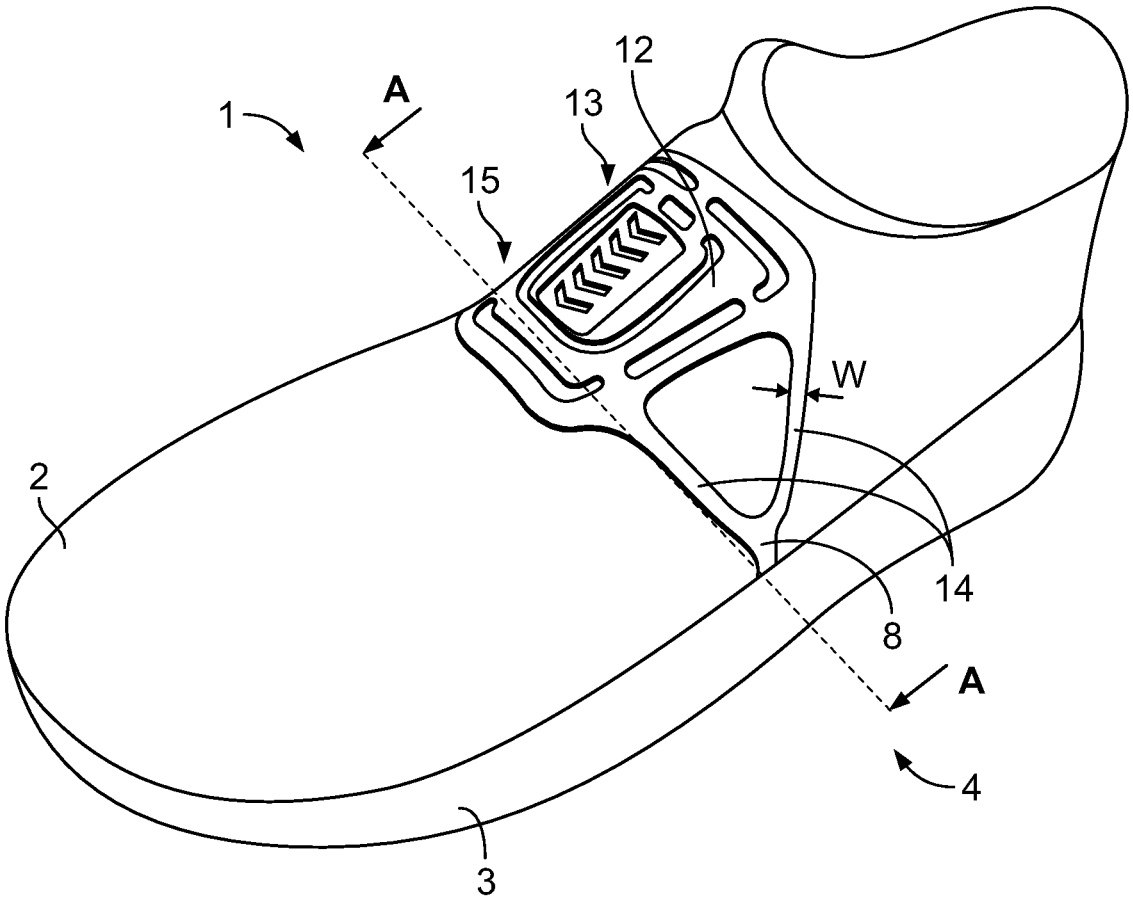

gearing (10) or profile to pull the strap (8) in a translational direction (T) at the rotation of the worm (11).

19 Claims, 7 Drawing Sheets

(56) References Cited

U.S. PATENT DOCUMENTS

| | | | | |
|---|---|---|---|---|
| 2004/0231189 | A1* | 11/2004 | Seamans | B29D 35/02 36/3 R |
| 2006/0000116 | A1* | 1/2006 | Brewer | A43C 5/00 36/11.5 |
| 2007/0261270 | A1 | 11/2007 | Nadel et al. | |
| 2014/0130466 | A1* | 5/2014 | Potter | A01L 15/00 54/82 |
| 2015/0014463 | A1 | 1/2015 | Converse et al. | |
| 2016/0143396 | A1* | 5/2016 | Beers | H01L 29/7827 36/50.1 |
| 2016/0302530 | A1* | 10/2016 | Smith | A43C 11/00 |
| 2017/0215525 | A1* | 8/2017 | Labbe | A43C 11/1493 |
| 2017/0265592 | A1 | 9/2017 | Schneider et al. | |
| 2017/0265594 | A1 | 9/2017 | Walker et al. | |
| 2018/0125168 | A1* | 5/2018 | Beers | A43C 1/00 |
| 2018/0310670 | A1* | 11/2018 | Rovekamp, Jr. | G05B 15/02 |
| 2018/0368526 | A1* | 12/2018 | Bock | A43B 3/34 |
| 2019/0098963 | A1* | 4/2019 | Beers | A43C 11/008 |
| 2020/0054096 | A1* | 2/2020 | Beers | A43B 7/143 |

FOREIGN PATENT DOCUMENTS

| | | | |
|---|---|---|---|
| CN | 107847016 | A | 3/2018 |
| CN | 108135312 | A | 6/2018 |
| DE | 19833801 | A1 | 2/2000 |
| JP | 1987011401 | A | 1/1987 |
| WO | 2017/185160 | A1 | 11/2017 |
| WO | 2018/095501 | A1 | 5/2018 |

OTHER PUBLICATIONS

Second Office Action from corresponding Chinese Patent Application No. 201880094501. 7 dated Mar. 2, 2022 (8 pages) (English translation included).

International Search Report and Written Opinion of International Application No. PCT/EP2018/065754, dated Feb. 19, 2019, 11 pages.

International Preliminary Report on Patentability (Form IPEA/409) of International Application No. PCT/EP2018/065754, dated Jul. 29, 2020, 21 pages.

* cited by examiner

SHOE, ESPECIALLY A SPORTS SHOE

This application is a U.S. National Stage application, filed pursuant to 35 U.S.C. § 371, of international application no. PCT/EP2018/065754, filed on Jun. 14, 2018, the contents of which is incorporated herein by reference in its entirety.

The invention relates to a shoe, especially to a sports shoe, with a shoe upper and a sole connected with the shoe upper, wherein the shoe comprises a central fastener for lacing the shoe at the foot of a wearer, wherein the central fastener comprises at least one tensioning element which is arranged on or in a region of the shoe upper by which a lacing force can be exerted onto the region of the shoe upper and at least one gear element driven by at least one electric motor, wherein a section of the tensioning element can be pulled against a fixed location of the shoe by means of the gear element to create a tensioning force for lacing the shoe at the foot of the wearer.

A shoe of the generic kind, i. e. with an electric motor operated central fastener is known from DE 298 17 003 U1. Here, a tensioning roller is electric motor operated for winding of a tensioning element being a cable so that the shoe can be laced and de-laced automatically and electrically respectively.

Detrimentally, the pre-known central fastener (or central closure system) requires a certain space which is not always available at a shoe, especially at a sports shoe.

Thus it is an object of the present invention to propose a shoe with a central fastener which has a very low demand with respect to the required space. Thus, it is aimed that the central closure system is very compact.

The solution of this object according to the invention is characterized in that the section of the tensioning element is a strap which comprises a gearing or a profile, wherein the gear element comprises a worm which engages into the gearing or profile to pull the strap in a translational direction at the rotation of the worm.

The gearing is preferably realized by a plurality of parallel grooves which are machined, especially punched, into the strap.

The tensioning element comprises preferably at least one laminar part which is arranged in the plane of the surface of the shoe upper, wherein the laminar part has a thickness measured perpendicular to the surface of the shoe upper and a width measured in the plane of the surface of the shoe upper, wherein the width is at least 10 times as big as the thickness, specifically preferred at least 25 times as big as the thickness. That is, the tensioning element is at least partially made of a quite thick material.

The laminar part comprises in this case preferably a central section which is arranged in the instep region of the shoe. The central section is preferably connected with at least one lateral section and at least one medial section, wherein the at least one lateral section and the at least one medial section run down from the central section to the sole.

A preferred embodiment of the invention proposes that two lateral sections and two medial sections are arranged, wherein a part of the central section and the two lateral sections and a part of the central section and the two medial sections form a triangular structure on the surface of the shoe upper.

The at least one lateral section and the at least one medial section merge preferably into each one strap. In this case it can be provided that two worms are arranged which each engage into one gearing or profile of the strap.

The tensioning element is preferably made of a thin panel sheet made of metal. The thickness of the panel sheet is preferably less than 2.0 mm, specifically preferred less than 1.0 mm. The panel sheet is preferably made of light metal, especially of aluminium or magnesium.

A switch for controlling the central fastener can be arranged in the central section. Preferably, the switch is made of unitary design with the tensioning element (i. e. as a one-piece element). The switch is preferably a contact sensor which is sensitive to a wipe movement of a finger of the user of the shoe onto an actuation surface of the contact sensor.

The control of the system can alternatively also be carried out by means of a mobile phone in which a respective app is loaded. In this case the user of the shoe can activate the lacing and de-lacing process by using his or her mobile phone.

The gear element and the electric motor are preferably arranged in the sole of the shoe.

As the section of the tensioning element is a strap which comprises a gearing or a profile, in which the worm of the gear element engages (i. e. meshes) it is possible to create a very compact design for the central fastener.

In the drawings embodiments of the invention are shown.

Figure 2:
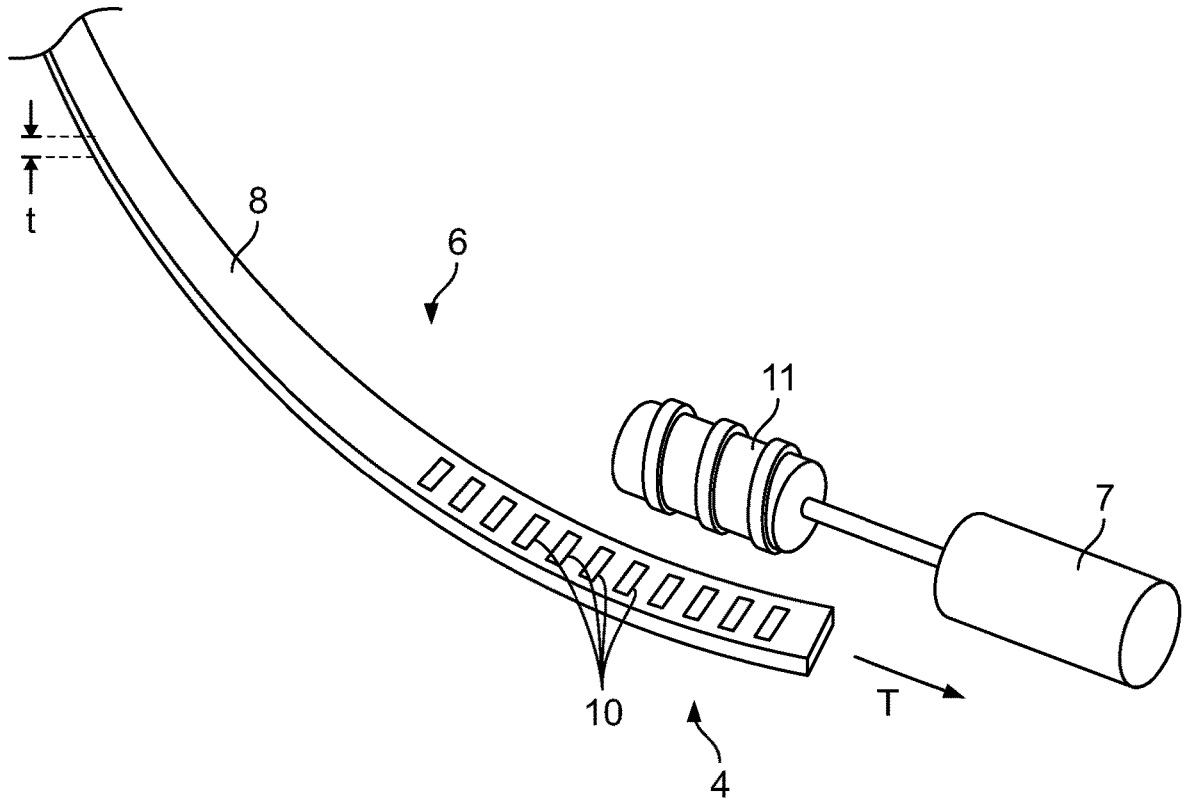
Figure 3:
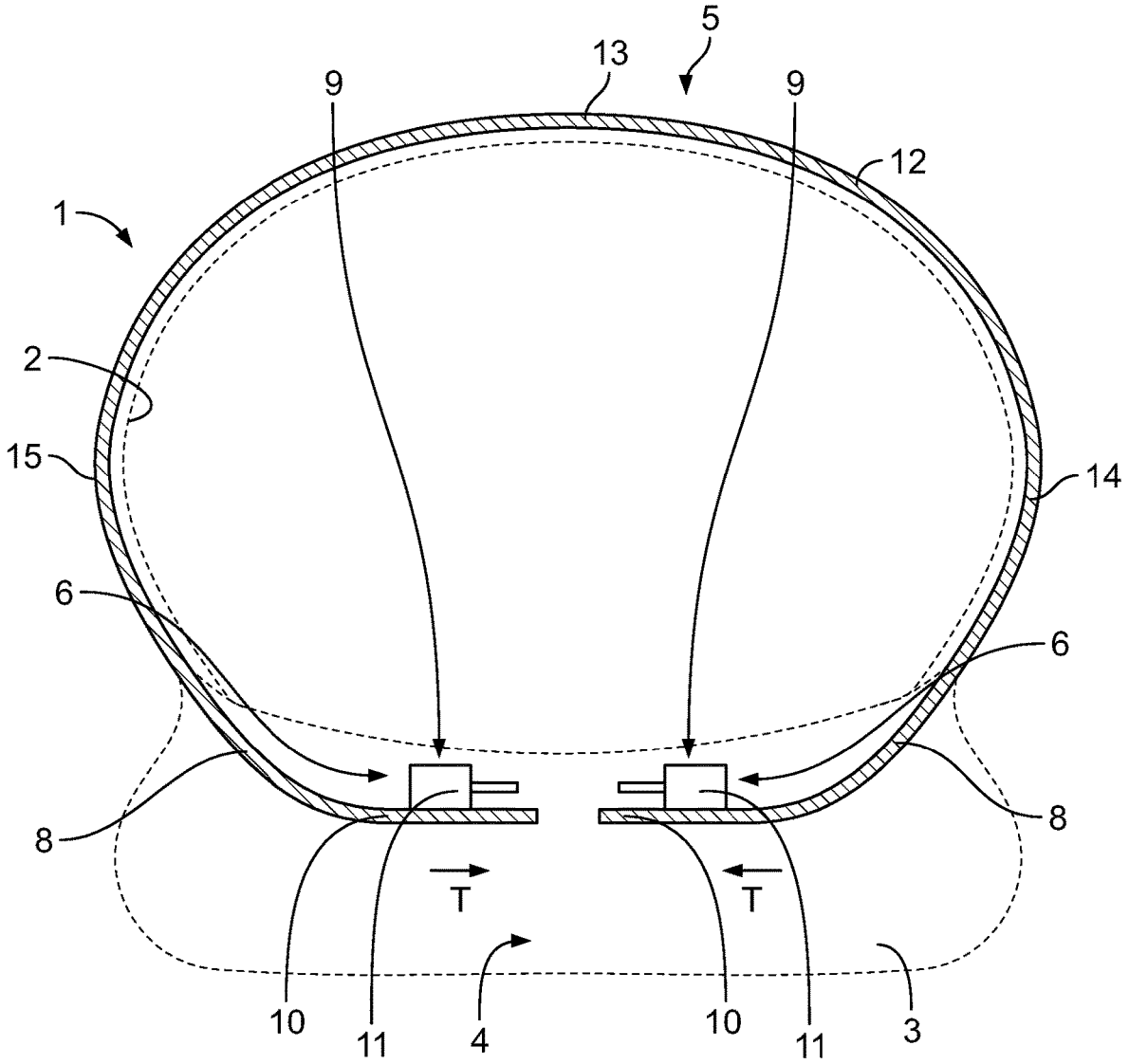
Figure 5:
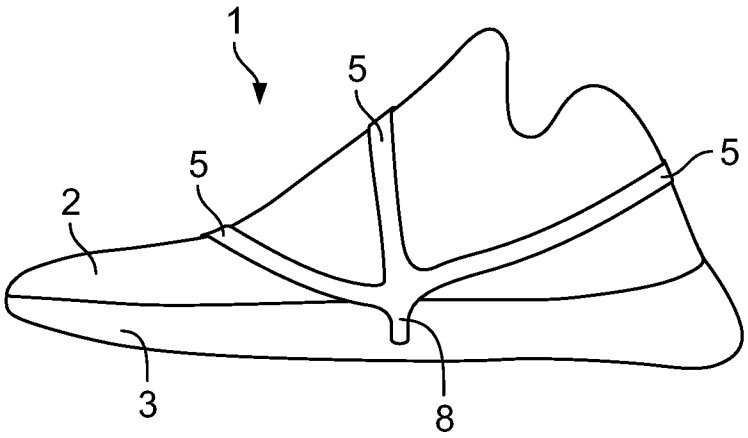
Figure 4:
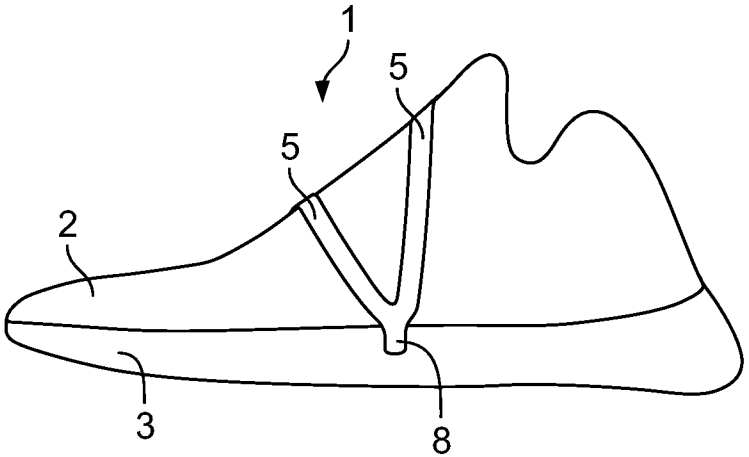
Figure 7:
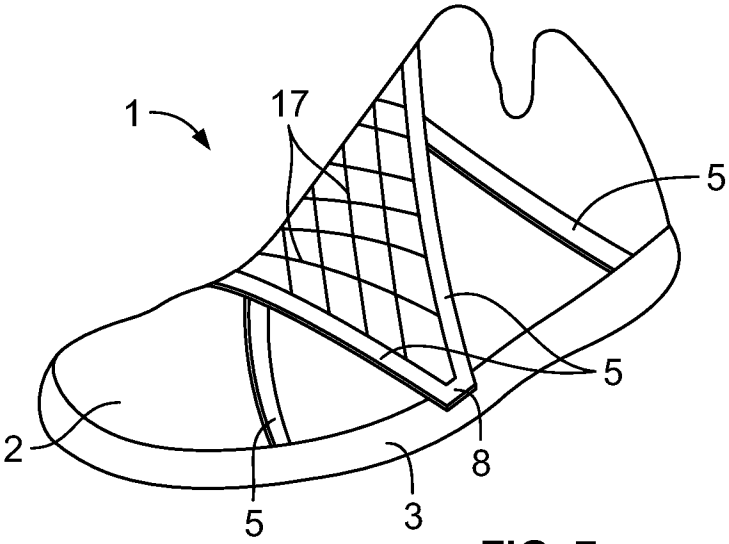
Figure 6:
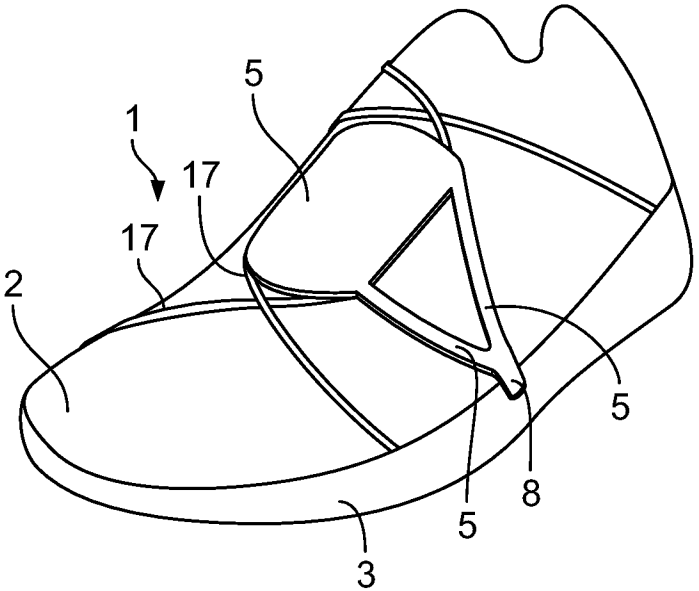
Figure 9:
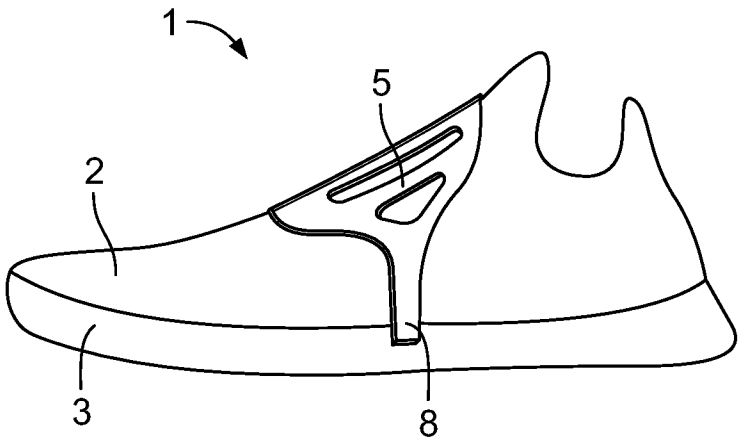
Figure 8:
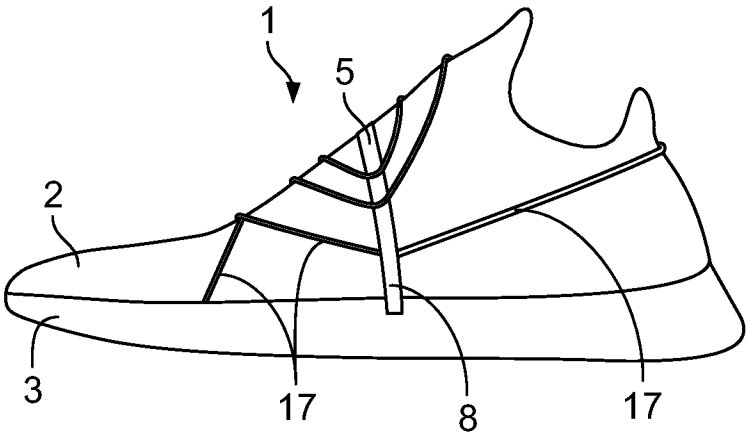
Figure 11:
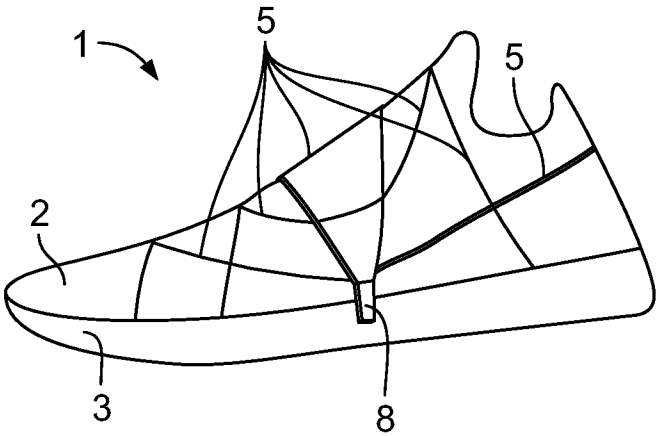
Figure 10:
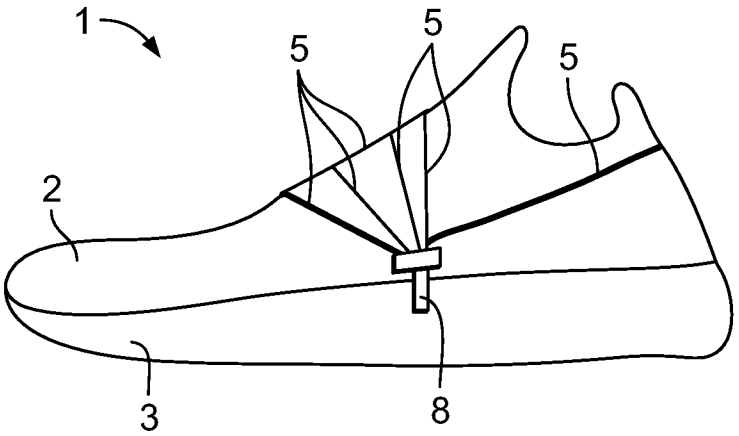

FIG. 1 shows a perspective view of a shoe which is provided with a central fastener according to a first embodiment of the invention, FIG. 2 shows an explosion view of a part of the central fastener, namely of a gear element with a worm and an electric motor and a strap with a gearing in which the worm meshes during intended use, FIG. 3 shows a section through the shoe perpendicular to its longitudinal axis showing the central fastener (without electric motors), FIG. 4 shows the side view of the shoe according to a second embodiment of the invention, FIG. 5 shows the side view of the shoe according to a third embodiment of the invention, FIG. 6 shows a perspective view of the shoe according to a fourth embodiment of the invention, FIG. 7 shows a perspective view of the shoe according to a fifth embodiment of the invention, FIG. 8 shows the side view of the shoe according to a sixth embodiment of the invention, FIG. 9 shows the side view of the shoe according to a seventh embodiment of the invention, FIG. 10 shows the side view of the shoe according to an eighth embodiment of the invention, and FIG. 11 shows the side view of the shoe according to a ninth embodiment of the invention.

In FIGS. 1 to 3 a first embodiment of the invention is shown. A shoe 1 has a shoe upper 2 and a sole 3 connected with the shoe upper 2. The lacing of the shoe at the foot of a wearer is carried out by a central fastener 4.

The central fastener 4 tensions a tensioning element 5 so that a tensioning force can be exerted to the shoe upper 2 and thus to the foot of the wearer.

The tensioning of the tensioning element 5 takes place by means of a gear element 6 (and more specifically by two gear elements 6 in the present embodiment). The gear element 6 is shown in FIG. 2 in an explosion view. It comprises an electric motor 7 which drives a worm 11. A section 8 of the tensioning element 5 is designed as a strap in which a gearing or profile 10 is machined. In the present case according to FIG. 2 the gearing 10 is established by a plurality of parallel grooves which are punched into the strap 8.

Worms 11 of the mentioned kind are well known in the art. Reference is made to common worm gears consisting of a driving worm and a driven worm wheel. Such a worm which can mesh with the grooves in the strap 8 is suitable for the present solution.

The electric motor 7 as well as the worm 11 are arranged at a fixed location 9 of the shoe and more specifically within the sole 3. Accordingly, when the electric motor 7 rotates the worm 11 and when the worm 11 meshes with the gearing 10 in the strap 8, the end of the strap 8 is moved in a translational direction T (see FIGS. 2 and 3).

Fixed location 9 means in the above context that this is a location in the shoe against which the strap 8 is pulled at the actuation of the gear element 6. That is, while the strap 8 can be moved in translational direction T relatively to the shoe and specifically in the sole 3, the worm 11 together with the electric motor 7 is arranged stationary in the shoe 1 and specifically in the sole 3.

The strap 8 is a part of the tensioning element 5 which is made of a thin sheet metal plate which is machined according to the shape as becomes apparent from FIG. 1, i. e. the tensioning element 5 consists substantially of a laminar part 12.

The tensioning element 5 is thus produced from a thin material with a thickness t which is preferably below 1.0 mm. Compared with the thickness t the width w of the different sections of the tensioning element 5 (see FIG. 1) is substantially bigger, e. g. at least 10 times of the thickness t. Accordingly, the tensioning element 5 comprises certain strip-like sections which are arranged in the surface of the shoe upper 2 (with the width w) which have a small extension perpendicular to the surface of the shoe upper 2 (with the thickness t).

As can be seen specifically from FIG. 3 the laminar part 12 of the tensioning element 5 merges in the lateral and medial side of the shoe upper 2 in a lateral section 14 and a medial section 15. In the case of the depicted embodiment two strip-like lateral sections 14 and two medial sections 15 merge into the strap 8 which in turn carries the profile 10.

Preferably a section of the laminar part 12 and the two strip-like lateral sections 14 as well as a section of the laminar part 12 and the two medial sections 15 form a triangular structure as becomes a parent from FIG. 1 (for the lateral sides of the shoe).

In FIG. 3 it can be seen that two gear element 6 are arranged in the sole 3 of the shoe 1, wherein each gear element 6 cooperates with a strap 8 of the tensioning element 5. It should be noted that in FIG. 3 the two gear elements 6 are offset in a direction perpendicular to the drawing plane of FIG. 3. When the two electric motors 7 (not shown in FIG. 3) are operated simultaneously the two straps 8 are moved toward another or away from another (depending on the rotation direction of the electric motors 7) to lace or to de-lace the shoe 1.

As can be seen from FIG. 1 the laminar part 12 of the tensioning element 5 has a central section 13. A switch 16 is arranged in the centre of the central section 13 by which the lacing and the de-lacing of the shoe can be carried out by the wearer of the shoe by a wipe movement of a finger across the surface of the switch 16.

Thus, when the two electric motors 7 (not shown) of the two gear elements 6 in FIG. 3 are activated the two straps 8 are pulled by the two worms 11 in the translational direction T and thus the shoe is laced at the foot of the wearer.

Coming now to FIGS. 4 to 11 different alternative embodiments of the present invention and more specifically of the tensioning element 5 are shown. As a common feature the design of the central fastener is always as described in connection with FIGS. 1 to 3. Thus, the different embodiments of FIGS. 4 to 11 concern the design of the tensioning element 5 only.

In FIG. 4 the tensioning element 5 has basically two strip-like sections which merge at the location of the strap 8 and which form a V-shaped design at the medial and at the lateral side of the shoe.

In FIG. 5 additionally a strip-like section is provided which runs around the heel section of the shoe to improve the lacing effect.

The embodiment according to FIG. 6 is similar to that one of FIG. 4. Additionally, some cables 17 are arranged which are connected with the tensioning element 5 and the sole 3 and which provides an additional lacing when the tensioning elements 5 is put under tension by a movement of the strap 8 by means of the central fastener 4.

In FIG. 7 additional strip-like part of the tensioning element 5 are provided in the forefoot and the rearfoot region. Also here cables 17 are provided which span over the instep region of the shoe.

In FIG. 8 the tensioning element 5 is basically formed by only one strip-like section (one in the lateral side and one in the medial side of the shoe) which are connected with cables 17 which are guided in the instep region of the shoe as well as in the forefoot and in the heel region of the shoe.

In FIG. 9 the tensioning element 5 consists basically of a single section which merges in the lateral and in the medial side of the shoe into the strap 8.

In FIG. 10 the single elements of the tensioning element 5 are quite thin and designed as cables which run across the instep region of the shoe and around the heel section of the same.

Finally, in FIG. 11 the tensioning element 5 is designed as a net-like structure made of different cables which finally are tensioned by the strap 8.

The cables 17 (being finally a part of the tensioning element 5) can be connected with another part of the tensioning element 5 for example by soldering.

As a preferred manufacturing method of the whole tensioning element 5 (with straps 8 but without cables 17) it is suggested to cut out the required shape of the tensioning element 5 from a thin (e. g. rectangular) metal plate by punching, laser cutting, electron beam cutting or the like. By this method also the grooves 10 can be cut out efficiently. This allows an economic production of the tensioning element 5.

It is also possible to produce the tensioning element 5 by connecting several parts together. So, for example the straps 8 can be produced separately and then fixed to the rest of the structure of the tensioning element 5.

Not shown in the figures are a battery and wires which are of course necessary for the operation of the electric motors 7.

REFERENCE NUMERALS

1 Shoe
2 Shoe upper
3 Sole
4 Central fastener
5 Tensioning element
6 Gear element
7 Electric motor
8 Section of the tensioning element (strap)
9 Fixed location of the shoe
10 Gearing/profile
11 Worm

12 Laminar part of the tensioning element
13 Central section
14 Lateral section
15 Medial section
16 Switch
17 Cable
T Translational direction
t Thickness
w Width

The invention claimed is:

1. A shoe, comprising a shoe upper and a sole connected with the shoe upper, wherein the shoe comprises a central fastener for lacing the shoe, wherein the central fastener comprises:

at least one tensioning element that is positioned about a region of the shoe upper, the at least one tensioning element being configured to exert a lacing force on the region of the shoe upper; and at least one gear element coupled to at least one electric motor, wherein the at least one gear element pulls a section of the at least one tensioning element against a fixed location of the shoe to create a tensioning force for lacing the shoe, wherein the section of the at least one tensioning element is a strap comprising a gearing, wherein the gearing includes a plurality of parallel grooves, wherein the at least one gear element comprises a worm gear that rotatably engages the gearing to pull the strap in the sole in a translational direction, and wherein the plurality of parallel grooves are machined into the strap.

2. The shoe of claim 1, wherein the at least one tensioning element comprises at least one laminar part that is positioned in a plane of a surface of the shoe upper, wherein the at least one laminar part has a thickness measured perpendicular to the surface of the shoe upper and a width measured in the plane of the surface of the shoe upper, wherein the width is greater than the thickness.

3. The shoe of claim 2, wherein the at least one laminar part comprises a central section that is positioned in an instep region of the shoe.

4. The shoe of claim 3, wherein the central section is connected to at least one lateral section and at least one medial section, wherein the at least one lateral section and the at least one medial section extend from the central section to the sole.

5. The shoe of claim 4 further comprising two lateral sections and two medial sections, wherein the two lateral sections are each disposed at an angle from a lateral portion of the central section and the two medial sections are each disposed at an angle from a medial portion of the central section.

6. The shoe of claim 4, wherein the at least one lateral section attaches to a first strap and the at least one medial section attaches to a second strap.

7. The shoe of claim 6 further comprising a first worm that engages a first gearing of the first strap and a second worm that engages a second gearing of the second strap.

8. The shoe of claim 1, wherein the at least one tensioning element includes a panel sheet comprising metal.

9. The shoe of claim 8, wherein a thickness of the panel sheet is less than 2.0 mm.

10. The shoe of claim 8, wherein the panel sheet comprises aluminium or magnesium.

11. The shoe of claim 3, wherein the central section includes a switch for controlling the central fastener.

12. The shoe of claim 11, wherein the switch and the at least one tensioning element comprise a unitary element.

13. The shoe of claim 11, wherein the switch is a contact sensor having an actuation surface configured to be actuated by a finger of a user.

14. The shoe of claim 1, wherein the at least one gear element and the at least one electric motor are positioned in the sole of the shoe.

15. A shoe, comprising a shoe upper and a sole connected with the shoe upper, wherein the shoe comprises a central fastener for lacing the shoe, wherein the central fastener comprises:

at least one tensioning element that is positioned about a region of the shoe upper, the at least one tensioning element being configured to exert a lacing force on the region of the shoe upper; and a gear element comprising a worm gear, wherein the at least one tensioning element comprises a first strap having a first end and a second strap having a second end, the first end of the first strap and the second end of the second strap are disposed in the sole and are spaced apart a distance from one another, wherein a first plurality of parallel grooves are machined into the first strap, wherein, when the first plurality of parallel grooves of the first strap are engaged, the first end of the first strap is moved toward the second end of the second strap in the sole to reduce the distance from one another and to exert the lacing force on the region of the shoe upper, and wherein the gear element is configured to engage at least one of the first plurality of parallel grooves or a second plurality of parallel grooves to create a tensioning force for lacing the shoe.

16. The shoe of claim 15, wherein the first plurality of parallel grooves are punched into the first strap and the second plurality of parallel grooves are punched into the second strap.

17. The shoe of claim 16, wherein the gear element is coupled to an electric motor.

18. A shoe, comprising a shoe upper and a sole connected with the shoe upper, wherein the shoe comprises a central fastener for lacing the shoe, wherein the central fastener comprises:

at least one tensioning element that is positioned about a region of the shoe upper, the at least one tensioning element being configured to exert a lacing force on the region of the shoe upper, wherein the at least one tensioning element includes a central section that is positioned in an instep region of the shoe, the central section including a switch for controlling the central fastener, the switch and the at least one tensioning element comprising a unitary element, wherein the switch includes a contact surface that is configured to be actuated by a finger of a user; and a gear element comprising a worm gear, wherein the at least one tensioning element includes a strap that comprises a first plurality of parallel grooves that are machined into the strap, the strap having an end that is at least partially disposed in the sole of the shoe, wherein, in a first actuated configuration of the at least one tensioning element, the end of the strap is displaced relative to a fixed location of the shoe to exert the lacing force on the region of the shoe upper and tighten the shoe, and wherein the gear element is coupled to an electric motor and is configured to engage at least one of the first plurality of parallel grooves or a second plurality of parallel grooves for lacing the shoe.

19. The shoe of claim 18, wherein, in a second actuated configuration of the at least one tensioning element, the end of the strap is displaced relative to the fixed location of the shoe to decrease the lacing force and loosen the shoe.

* * * * *